United States Patent [19]

Carley

[11] 4,450,508

[45] May 22, 1984

[54] SELF CENTERING UNDERGROUND MINE LAMP

[76] Inventor: James A. Carley, 1502 W. 228th St., Torrance, Calif. 90501

[21] Appl. No.: 477,180

[22] Filed: Mar. 21, 1983

[51] Int. Cl.[3] ..... F21L 15/14

[52] U.S. Cl. ..... 362/105; 362/106; 362/186; 362/188; 362/203; 362/372; 362/375

[58] Field of Search ..... 362/105, 106, 186, 188, 362/203; 372, 375

[56] References Cited

U.S. PATENT DOCUMENTS

| | | | |
|---|---|---|---|
| 1,421,944 | 7/1922 | Humiston | 362/187 |
| 1,751,432 | 3/1930 | Voorhees | 362/187 |
| 1,991,753 | 2/1935 | Kurlander | 362/187 |

*Primary Examiner*—Stepehn J. Lechert, Jr.
*Attorney, Agent, or Firm*—William C. Babcock

[57] ABSTRACT

A mine lamp having an improved base structure and envelope that cooperate with the socket and lens of an underground miners head piece to maintain the lamp in a centered position relative to a reflector as the latter is manually adjusted relative to the lamp, and by so doing substantially increasing the light output from the head piece.

3 Claims, 5 Drawing Figures

SELF CENTERING UNDERGROUND MINE LAMP

DESCRIPTION OF THE PRIOR ART

The conventional prior art mine lamp does not center in the head piece supported on the miners helmet. This off centering is due to the base of the lamp loosely engaging the socket and permitting the lamp to pivot laterally relative to the latter. The light pattern from such an off centered lamp is not properly collimated and a light spot of maximum intensity is not obtained.

When the lamp is off centered in a head piece the miner has but two alternatives, he may either strike the head piece and hope that the lamp will return to a centered position, or use the lamp with it producing less than a desirable spot.

A major object of the present invention is to provide an improved miners lamp in which a cylindrical bushing of increased diameter encircles the base of the lamp to slidably and snuggly engage the interior surface of a cylindrical extension of the reflector and by so doing maintain the lamp on a centered position relative to the reflector both when the reflector is stationary and when being adjustably moved relative to the lamp.

A further object of the invention is to supply a miners lamp in which the transparent envelope has a free convex end portion of small radius that pressure contacts a centered dimple on the interior surface of the lens of the head piece to further assist the base in maintaining the lamp in a centered position relative to the reflector of the head piece.

Yet another object of the invention is to supply a self centering lamp that may be used in a conventional miners head piece without substantial alteration thereto.

A still further object of the invention is to furnish an improved miners lamp in which both the base and envelope thereof cooperate to maintain it in a centered position in a miners head piece.

SUMMARY OF THE INVENTION

An improved miners lamp of the type that includes a cylindrical base and envelope in which the base supports a cylindrical bushing of increased diameter that slidably and snuggly engages the interior surface of a cylindrical extension of the reflector and the envelop has a free convex end portion that may pressure contact a centered dimple on the interior surface of the lens of the head piece to maintain the lamp at a centered position relative to the reflector, both when the reflector is stationary, as well as when the reflector is being adjustably moved relative to the lamp. Due to the lamp being at all times in a centered position relative to the reflector, a collimated beam of light is emitted from the head piece to produce a spot of maximum intensity.

BRIEF DESCRIPTION OF THE DRAWINGS

FIG. 5 is a fragmentary cross sectional view of the head piece taken on the line 5—5 of FIG. 4.

DESCRIPTION OF THE PREFERRED EMBODIMENT

Figure 1:
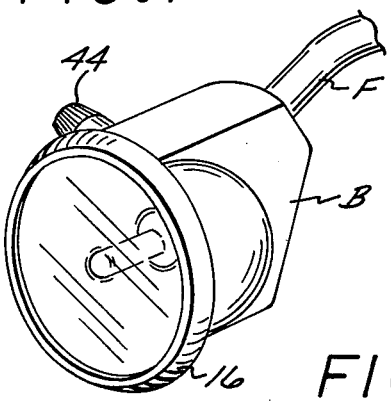
FIG. 1 is a perspective view of a miners head piece in which the self centering lamp of the present invention is disposed.
Figure 3:
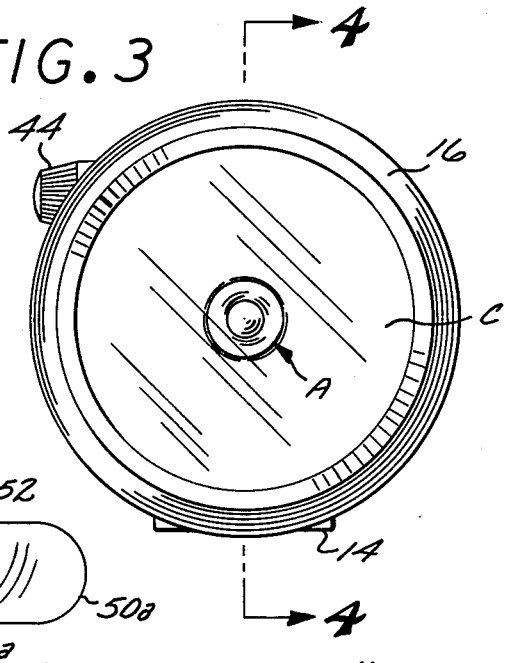
FIG. 3 is a front elevational view of the head piece with the lamp occupying a centered position therein.
Figure 2:
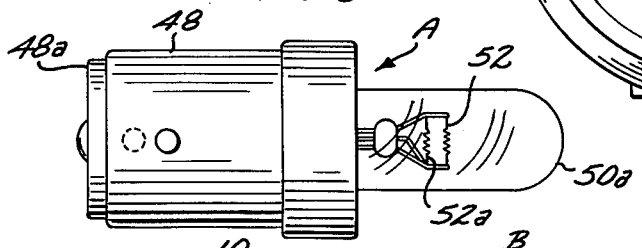
FIG. 2 is a side elevational view of the self centering lamp.

The improved lamp A of the present invention is illustrated as being used in a conventional head piece B adapted to be secured to an underground miners helmet (not shown).

The head piece includes a housing 10 of a polymerized resin or like material, which housing includes a back wall 12 from which a cylindrical shell 14 extends forwardly. The shell 14 has external threads **14*a* on the forward portion thereof. A retaining ring 16 is provided that has interior threads 16*a* thereon that engage threads 14*a*. The retaining ring includes a circular inwardly extending lip 16*b***.

The lip **16*b* engages the outer peripheral portion of a circular lens C and holds the latter in abutting contact with a resilient ring 18 that abuts against the forward edge surface of shell 14. The lens C has a dimple 20 formed in the center of the inner surface 22** thereof.

Figure 4:
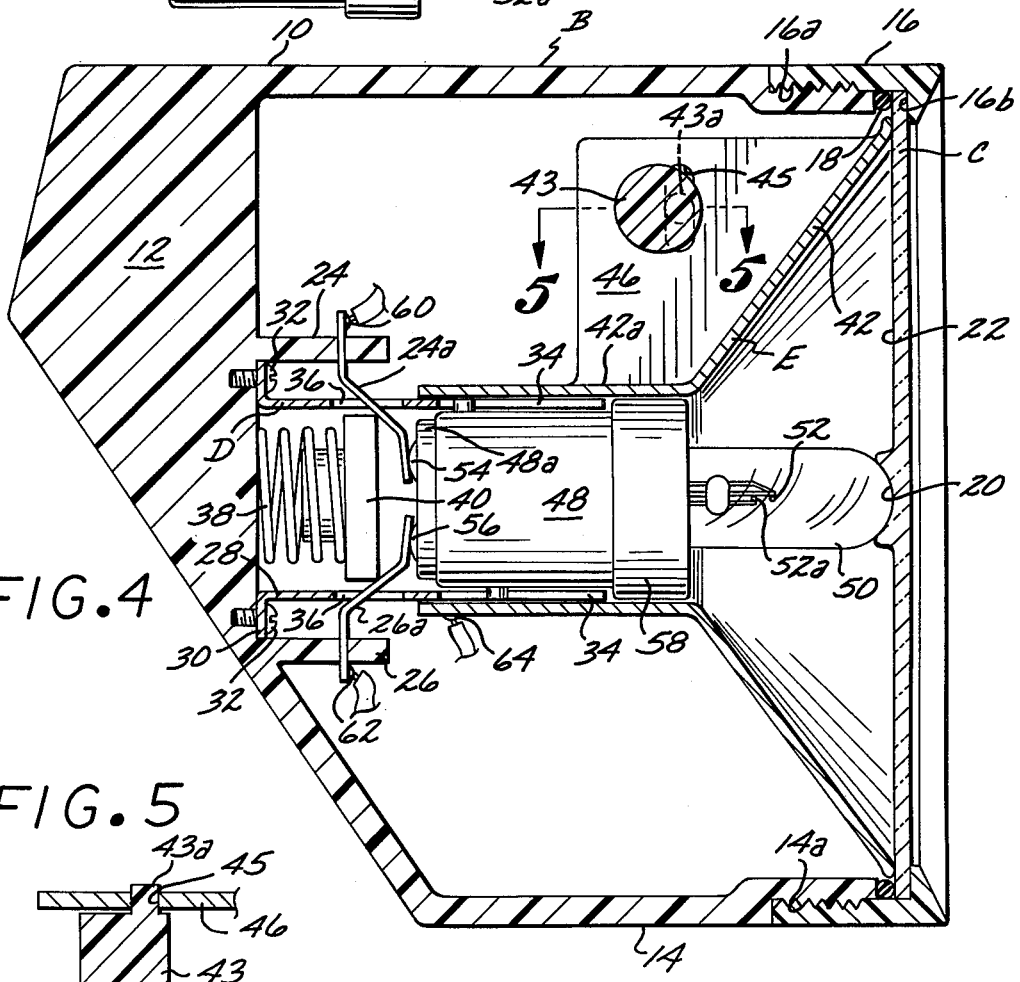
FIG. 4 is a longitudinal cross sectional view of the head piece taken on the line 4—4 of FIG. 3 and illustrating the lamp in a centered position in the head piece.

First and second elongate supports 24 and 26 extend forwardly in spaced relationship from the back wall 12 and have first and second elongate resilient electrical conducting members **24*a* and 26*a* mounted thereon as shown in FIG. 4**.

A socket D is provided that is defined by a metallic tubular member 28 that has an outwardly extending flange on the rearward end thereof through which screws 32 extend to engage back wall 12. Tubular member 28 has a pair of elongate slots 34 therein that are parallel and extend rearward from the forward end of the tubular member. The tubular member 28 has a pair of oppositely disposed openings 36 therein through which the members **24*a* and 26*a*** extend into the rearward interior of the socket D.

A compressed helical spring 38 is disposed longitudinally in the rear portion of socket D as shown in FIG. 4, with a rear end of the spring abutting against the back wall 12 and the forward end of the spring urging a generally cylindrical shaped force exerting member forwardly in the socket D.

A light reflector E forms a part of head piece B. The reflector E includes a silvered rearwardly and inwardly extending shell 42 that on the rearward end develops into a cylindrical extension **42*a*** that is slidably mounted on the socket D.

The head piece B as may be seen in FIG. 1 includes a manually operated adjustment button 44 that may be used to rotate a shaft 43 that is supported in housing 12, and which shaft has a pin **43*a*** projecting from the free end thereof.

The pin **43*a* engages an elongate slot 45 defined in a web 46 secured to reflector shell 42 and extension 42*a*, with the shaft 43** when rotated moving the reflector E longitudinally relative to the socket D.

The lamp A includes a cylindrical metallic base 48 that has a rear end surface **48*a* and two oppositely disposed guide pins 48*b* that slidably engage the slots 34 as shown in FIG. 4. A transparent narrow tubular envelope 50 extends forwardly from the base 48 and terminates in a convex end 50*a* that pressure contacts the dimple 20. The envelop 50 is illustrated as having first and second filaments 52 and 52*a*** supported therein.

First and second electrical conducting contact terminals 54 and 56 that are insulated from one another project from the rear end **48*a* and by electrical conducting means (not shown) in the base 48 are connected to the first filament 52. The second filament 52***a* may be supplied electric power through the metallic base 48 and the second contact terminal 56 which has a common conductor (not shown) extending therefrom. When the first filament 52 burns out the second filament 52*a* may be used for illumination purposes.

The head piece B has an electric conducting cable F associated therewith that extends to a battery (not shown). The cable F has first, second and third electrical conductors 60, 62 and 64 therein the supply electricity to the first and second members 24, 24*a* and base 48 as shown in FIG. 4. Should it be desired the lamp A could have but a single filament therein.

In FIG. 4 it will be seen that the cylindrical bushing 58 snuggly and slidably engages the interior surface of the reflector extension 42*a*. The spring 38 is at all times compressed and though the member 40 urges the free end portions of the resilient electrical conducting members 24*a* and 26*a* forwardly to maintain the convex end 50*a* of envelop 50 in pressure contact with dimple 20 that is centered in lens C. Due to this support for the lamp A, the lamp cannot move laterally as the reflector E is adjusted longitudinally relative thereto by manually rotating the button 44.

From experience it has been found that the light output from the reflector E may be increased up to fifty percent by maintaining the lamp A in a true centered position relative thereto.

The bushing 58 is of sufficient width that when it is in slidable contact with the interior surface of the extension 42*a*, the lamp A will not tend to pivot laterally relative to the extension 42*a*.

The use and operation of the lamp A in a head piece B has been explained previously in detail and need not be repeated.

I claim:

1. In combination with a miners head piece of the type that includes a housing having a forward and rearward end, a lens secured to said forward end, a tubular socket that projects forwardly in said housing, a plurality of spring loaded, forwardly biased electrical conducting members rearwardly disposed in said socket, a reflector disposed in the forward interior portion of said housing, said reflector including a tubular rearwardly extending extension that has an interior surface and is slidably mounted on said socket, manually operated means for adjustably moving said reflector longitudinally relative to said socket, a self centering lamp for use with said miners head piece, said lamp including:

a. a cylindrical base having a forward and rearward end, said base including at least one electrical conducting filament supported forwardly thereof, and a plurality of electrical contact terminals electrically connected to said filament and in engagement with said electrical conducting members when said base is disposed in said socket;

b. a cylindrical bushing that encircles said bore adjacent said forward end and snuggly and slidably engages said interior surface of said reflector extension, said bushing of sufficient width that said base will not pivot relative to said extension; and c. a transparent rigid envelope that extends forwardly from said base, said envelop of sufficient length that said forwardly biased electrical conducting members will maintain the forward extremity of said envelope in pressure contact with said lens to at all times maintain said lamp in a centered position relative to said reflector.

2. A self centering lamp as defined in clam 1 in which said envelop has a convex forward end that pressure contacts a centered cavity in said lens to assist said cylindrical bushing in maintaining said lamp in said centered position relative to said reflector.

3. A self centering lamp as defined in claim 1 in which said envelope is tubular in shape.

* * * * *